US006442799B1

(12) United States Patent
Duarte et al.

(10) Patent No.: US 6,442,799 B1
(45) Date of Patent: Sep. 3, 2002

(54) HINGE

(76) Inventors: Carlos Duarte, 906 W. Donington St., Glendora, CA (US) 91741; Fred S. Romero, 19637 Golden Bough, Covina, CA (US) 91724

( * ) Notice: Subject to any disclaimer, the term of this patent is extended or adjusted under 35 U.S.C. 154(b) by 0 days.

(21) Appl. No.: 09/650,181

(22) Filed: Aug. 29, 2000

Related U.S. Application Data

(60) Provisional application No. 60/170,899, filed on Dec. 15, 1999.

(51) Int. Cl.[7] ..... E05F 1/08; E05D 11/06

(52) U.S. Cl. ..... 16/277; 16/282; 16/286; 16/288; 16/374; 16/377; 49/399; 312/325; 4/498

(58) Field of Search ..... 16/277, 281, 282, 16/286, 287, 288, 372, 374, 375, 377, 366–370; 49/381, 399, 291, 379; 312/325, 327, 328; 4/498, 494, 236, 240; 220/263, 264, 823, 824, 348

(56) References Cited

U.S. PATENT DOCUMENTS

| | | | | | |
|---|---|---|---|---|---|
| 586,476 | A | | 7/1897 | Coates | |
| 1,115,345 | A | | 10/1914 | Steuernagel | |
| 2,516,196 | A | * | 7/1950 | Fowler | 16/288 |
| 2,590,028 | A | | 3/1952 | Miller | 312/323 |
| 2,648,516 | A | | 8/1953 | Manetti et al. | 248/311 |
| 2,793,387 | A | | 5/1957 | Odell | |
| 2,840,847 | A | * | 7/1958 | Danser | 16/288 |
| 2,853,352 | A | | 9/1958 | Gittins | 312/218 |
| 3,001,225 | A | | 9/1961 | Squire | |
| 3,038,196 | A | | 6/1962 | Nyquist | |
| 3,261,051 | A | * | 7/1966 | Priest | 16/288 |
| 3,351,975 | A | * | 11/1967 | Koju | 16/288 |
| 3,539,239 | A | | 11/1970 | Mallonn | 312/307 |
| 4,223,420 | A | * | 9/1980 | Yukimoto et al. | 16/288 |
| 4,853,985 | A | | 8/1989 | Perry | 4/498 |
| 4,857,374 | A | | 8/1989 | Perry | 428/71 |
| 4,991,238 | A | * | 2/1991 | Forrest | 4/498 |
| 5,027,473 | A | * | 7/1991 | Hottmann | 16/286 |
| 5,131,102 | A | | 7/1992 | Salley et al. | 4/498 |
| 5,471,685 | A | | 12/1995 | Cross | 4/500 |
| 5,517,703 | A | | 5/1996 | Ouelette | 4/498 |
| 5,584,081 | A | | 12/1996 | Ouelette | 4/498 |
| 5,634,218 | A | | 6/1997 | Ouelette | 4/498 |
| 5,644,803 | A | | 7/1997 | Wilson | 4/500 |
| 5,689,841 | A | | 11/1997 | Black et al. | 4/498 |
| 5,819,332 | A | * | 10/1998 | Perry | 4/498 |
| 5,896,619 | A | * | 4/1999 | Koopman | 16/286 |
| 5,950,252 | A | * | 9/1999 | Fettes | 4/498 |
| 6,000,071 | A | * | 12/1999 | Fettes | 4/498 |

OTHER PUBLICATIONS

Franz Hettich K.G., Germany, The Complete Háfele, Jul. 1988, pp. 5.30–5.31.

* cited by examiner

*Primary Examiner*—Chuck Y. Mah
(74) *Attorney, Agent, or Firm*—Christie, Parker & Hale, LLP

(57) ABSTRACT

A hinge comprising a base and a plate rotataby coupled to the base about a turn axis fixed in the base. The hinge further includes a swing member rotably coupled to the plate about a pivot axis fixed relative to the plate and a spring coupled between the base and the plate which urges the plate to rotate about the turn axis in a first direction. The plate has limited rotation in the first direction about the turn axis as the swing arm has limited movement relative to the plate about the pivot axis in a second direction, opposite of the first direction. The limited movement of the swing arm is defined by a pivot limit. Movement of the swing arm toward and away from the pivot limit occurs about the pivot axis without effect of the spring on the arm. During contact of the swing arm with the pivot limit, the arm and the plate can move about the turn axis against the effect of the spring.

19 Claims, 13 Drawing Sheets

HINGE

CROSS-REFERENCE TO RELATED APPLICATION

This application claims priority to the U.S. Provisional Application No. 60/170,899, filed Dec. 15, 1999.

FIELD OF THE INVENTION

This invention is directed to an improved hinge mechanism, and more particularly, to a hinge having dual pivoting axes and a spring bias effective in only a portion of the hinge range of movement.

BACKGROUND

Hinges are used in various applications. One example of such use is the use of hinges for spa covers. When used in this capacity, the hinge is used to move the spa cover from its usage position atop the spa to a retracted position in which the spa tub is accessible to users. Many of these hinges comprise an arm connected between the spa cover and a pivot connected to a side of the spa housing. The pivot arm acts under continuous spring bias as the spa cover moves through its full range of motion from its usage position to its retracted position.

Experience has shown that spa cover hinges which now are commercially available have assorted deficiencies and problems, including complexity of parts and organization, lack of ruggedness, high levels of force required to operate them, especially if the cover must be moved against a spring bias throughout its movement from its usage position to its retracted position.

Accordingly, a need exists for an improved spa cover hinge system which seeks to avoid those and other deficiencies and problems found in currently available products.

SUMMARY OF THE INVENTION

The present invention provides an improved spa cover hinge system which seeks to avoid those and other deficiencies and problems found in currently available products. A presently preferred embodiment of the new spa cover hinge system is described below with reference to the accompanying drawings. The drawings depict the structures by which the lower end of each of a pair of swing arms is coupled to a spa housing for movement of the arm about multiple pivot axes relative to the spa housing. However, as noted below, a hinge embodying features and principles of this invention can be configured differently for use in other contexts and utilities.

Generally speaking, a hinge according to this invention comprises a base and a plate rotatably coupled to the base about a turn axis fixed in the base. The hinge further includes a swing member rotably coupled to the plate about a pivot axis fixed relative to the plate and a spring coupled between the base and the plate which urges the plate to rotate about the turn axis in a first direction. The plate has limited rotation in the first direction about the turn axis as the swing arm has limited movement relative to the plate about the pivot axis in a second direction, opposite of the first direction. The limited movement of the swing arm is defined by a pivot limit. Movement of the swing arm toward and away from the pivot limit occurs about the pivot axis without effect of the spring on the arm. During contact of the swing arm with the pivot limit, the arm and the plate can move about the turn axis against the effect of the spring.

In a presently preferred embodiment of the invention, the hinge is connectible between a spa housing and a spa cover which has a closed position atop the housing and an open position, where the spa cover is retracted away from atop the housing. The hinge includes a base plate which is attachable to a side of a spa housing, and a crank plate rotably coupled to the base plate about a first axis fixed in the base plate. A swing arm is rotably coupled at its proximal end to the crank plate about a second axis fixed in the crank plate and connectible to the spa cover at its distal end. A stop mounted onto the crank plate limits rotation of the swing arm about the second axis. A spring, operatively connected between the base plate and the crank plate, exerts a force on the crank plate creating a moment in a first rotational direction about the first axis. A spa cover connected to the arm at its distal end can travel along a path from its closed position to an open position. Along a first segment of the path, the crank plate does not rotate relative to the base plate, while along a second segment of the path, the crank plate turns about the second axis, acting against the force of the spring.

DESCRIPTION OF THE DRAWINGS

These and other features and advantages of the present invention will be better understood by reference to the following detailed description when considered in conjunction with the accompanying drawings, wherein.

DETAILED DESCRIPTION

Figure 1:
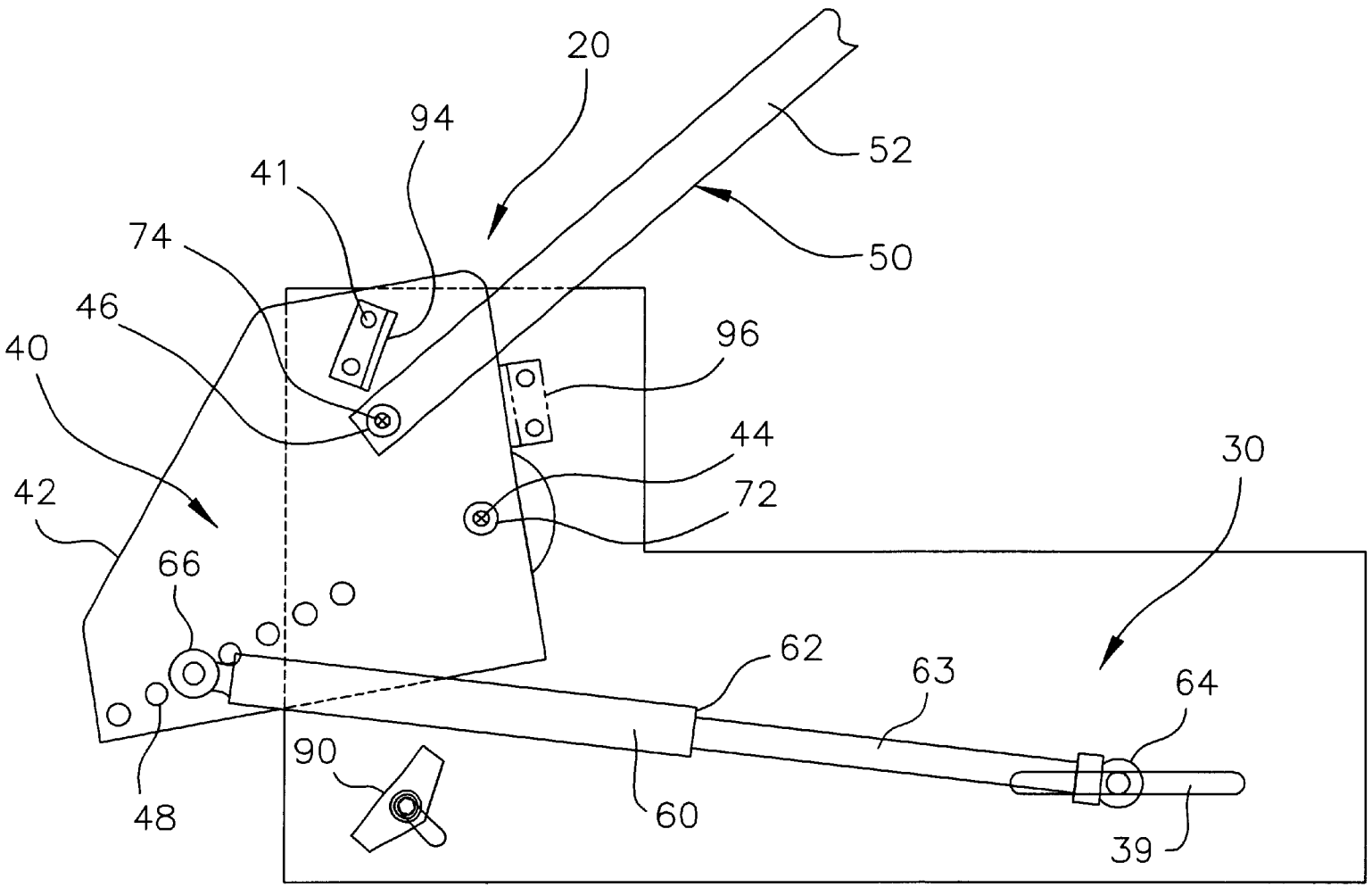
FIG. 1 is a simplified elevation view of the spa cover hinge of the present invention.

In a presently preferred embodiment of the invention arranged for use with a spa cover (see FIG. 8), there is provided a hinge having dual pivoting axes. Referring to FIG. 1, the hinge 20 comprises a base plate 30, a crank plate 40 rotably coupled to the base plate 30 about a first hinge pivot, a swing arm 50 rotably coupled to the crank plate 40 about a second hinge pivot, and a biasing member 60 attached between the base plate 30 and the crank plate 40.

In operation, a cover connected to the hinge moves from a closed position to an open position, as the hinge pivots about the first hinge pivot during a first portion of the range of motion between the open and closed positions. The pivot axis of the hinge changes to the second hinge pivot during a second remaining portion of the range of motion between the closed and open positions, as the hinge acts against a spring bias during the second range of motion.

Figure 2:
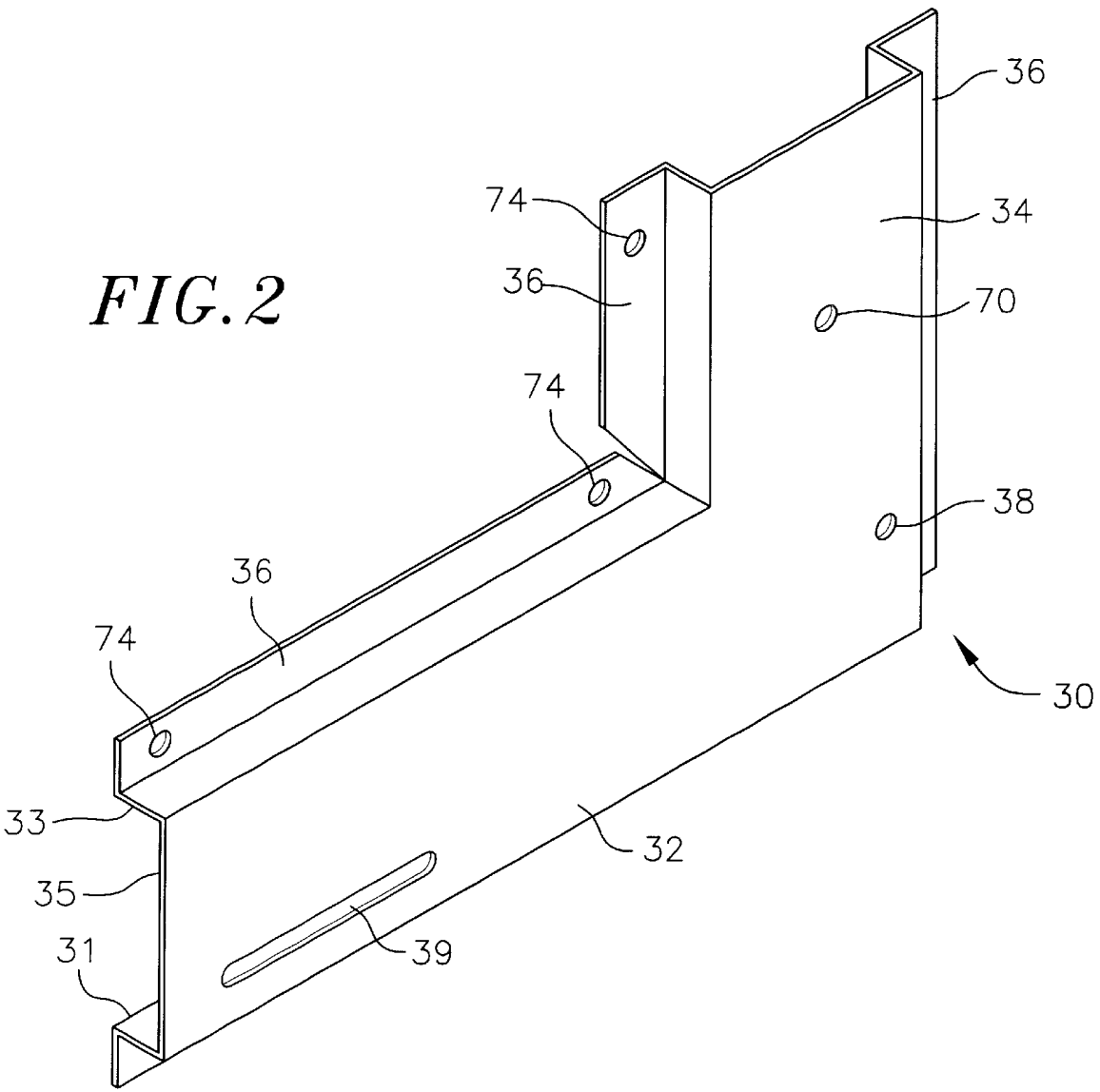
FIG. 2 is a perspective view of the base plate of the hinge in FIG. 1.

Referring to FIG. 2, the base plate 30, which can be of any suitable construction or made of any suitable material, preferably comprises sheet metal formed into an L-shape, having a U-shaped cross section 35. The base plate 30 includes a first leg portion 32 extending substantially perpendicular from a second leg portion 34. Attached to ends 31 and 33 of the U-shaped cross section 35 are a plurality of flanges 36. Each flange 36 defines a series of holes 74 used for securing the base plate 30 to a support structure.

The first leg portion 32 includes a horizontal slot 39 which runs along a distal region of the first leg 32. The second leg portion 34 includes an aperture 70, pertinent to a first hinge axis 72, located in its central region, and a second aperture 38 displaced along a lower edge region of the second leg 34.

Figure 3:
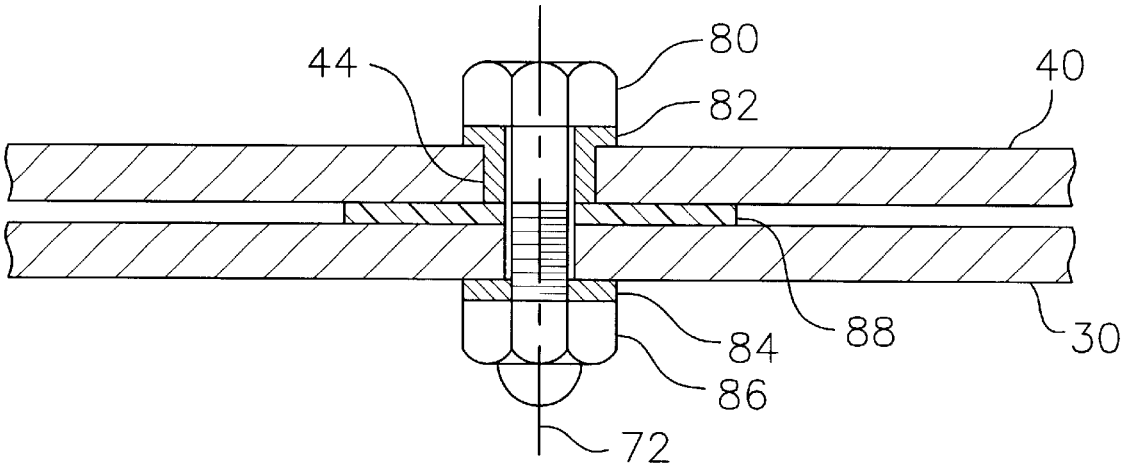
FIG. 3 is a fragmentary sectional view of the pivoting axis between the base plate and the crank plate of the hinge in FIG. 1.

Referring to FIG. 3, the crank plate 40 is rotably coupled to the base plate 30 about the first hinge axis 72. A bolt 80 extends through a brass bushing 82 press fit into an opening 44 in the crank plate 40, engaging a press nut 84 on the underside of the base plate 30. A plastic washer 88 is disposed between the base plate 30 and the crank plate 40, providing a bearing surface upon which the crank plate 40 may rotate relative to the base plate 30. A jam nut 86 may be secured to the end of the bolt 80 to restrict the bolt 80 from backing out of the press nut 84 as the crank plate 40 rotates. Referring now to FIG. 1, a stop 90, described more fully below, is preferably carried by the base plate 30 to limit the counter-clockwise movement of the crank plate 40 about the first hinge axis 72. A second stop or retaining member 96 (shown in broken lines in the drawing) can be carried by the base plate 30 to engage and limit the motion of the crank plate 40 in a clockwise direction about that fixed axis 72.

Referring to FIG. 1, the crank plate 40, which can be of any suitable construction or made of any suitable material, preferably comprises sheet metal having a generally rectangular shape and chamfer 42 located along an upper edge region of the plate 40. The crank plate 40 includes a threaded axle 46, defining a second hinge axis 74, centrally located on the crank plate 40, and a pair of threaded press studs 41 displaced in an upper central region of the crank plate 40, aligned in a vertical fashion. The crank plate 40 further includes a series of threaded adjustment holes 48 displaced along a lower edge portion of the crank plate 40, just below the chamfer 42, in an oblique orientation.

Figure 4:
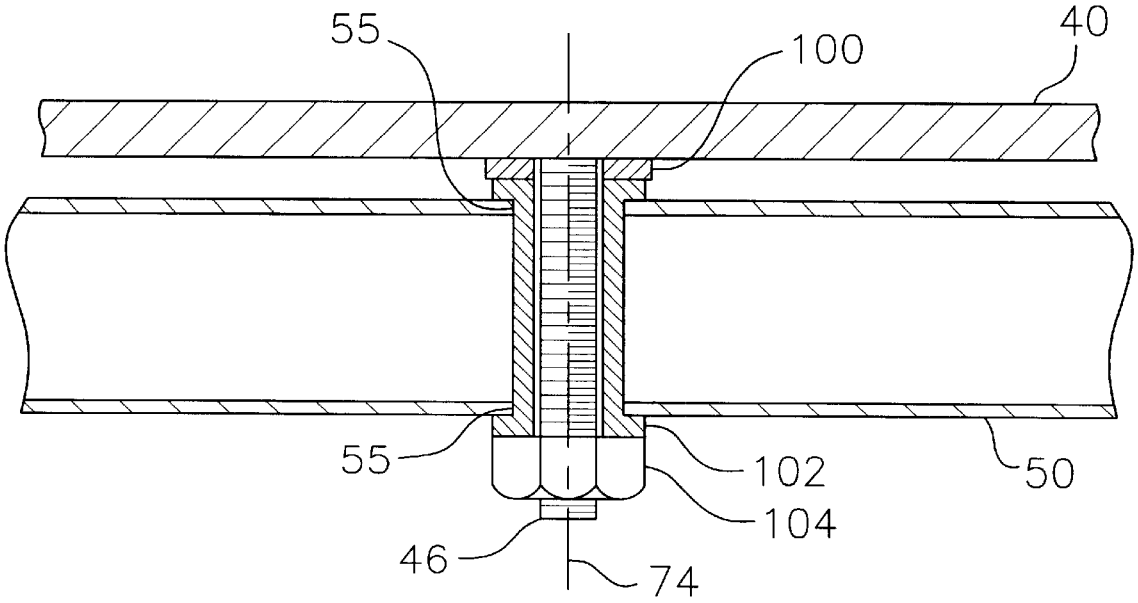
FIG. 4 is a fragmentary sectional view of the pivoting axis between the crank plate and the swing arm of the hinge in FIG. 1.

Referring to Fig. 4, the swing arm 50 is rotably coupled to the crank plate 40 about the second hinge axis 74. The threaded axle 46 extends through a brass bearing 102 press fit within a first set of aligned holes 55, located a long a proximal end of the swing arm 50, engaging a lock nut 104 at its end. A plastic seat 100 is displaced between the crank plate 40 and the swing arm 50, providing a bearing surface upon which the swing arm 50 may rotate relative to the crank plate 40. Referring now to FIG. 1, a stop or retainer 94 is fastened to the crank plate 40, as by the press studs 41, to limit the extent of rotation of the swing arm 50 about the second hinge axis 74 in a direction (counter-clockwise) which corresponds to movement of a panel from a closed position to an opened position.

As shown in FIG. 1, the swing arm 50 preferably is comprised by a square metal tube 52. A second set of aligned holes 54 (FIG. 8) are located at a distal end of the swing arm 50 for connecting the swing arm to a spa cover.

Figure 5:
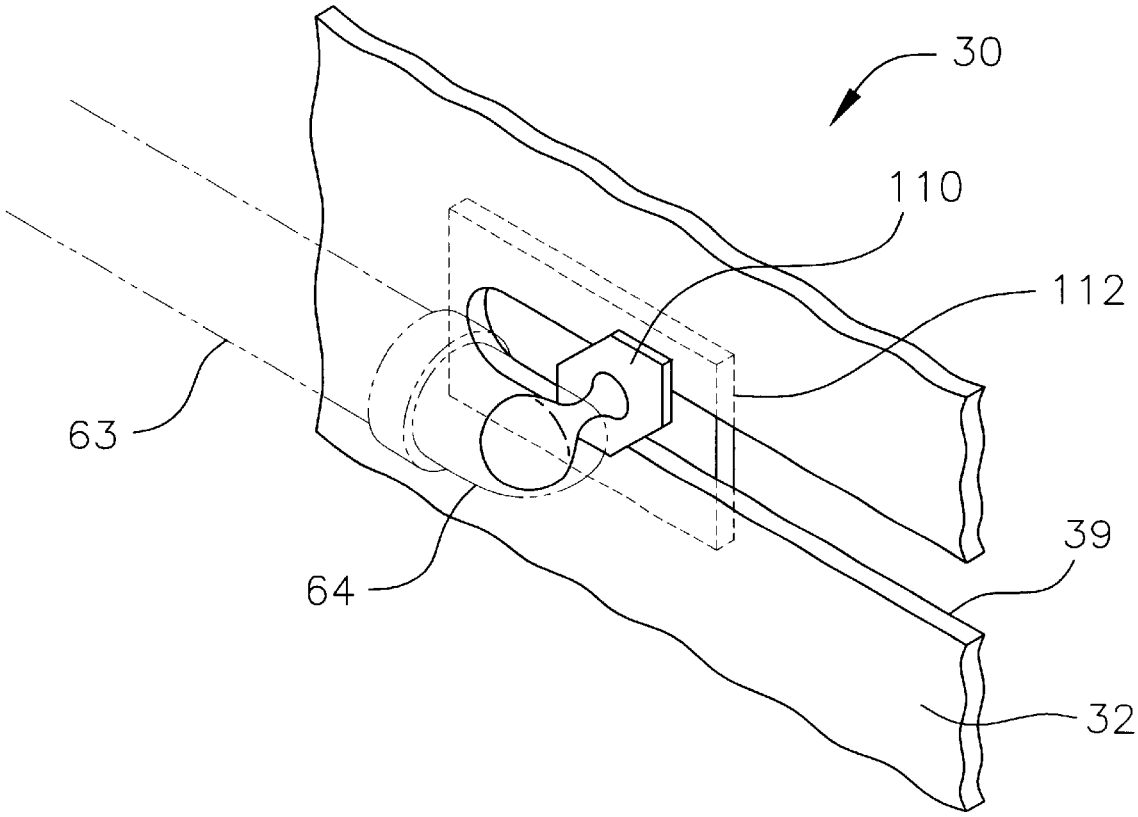
FIG. 5 is fragmentary perspective view of the connection between the gas spring and the adjustment slot of the hinge in FIG. 1.

The biasing member 60 in hinge 20 preferably is a linear gas spring. The biasing member 60 may be any suitable mechanism, including, but not limited to a coil or torsion spring. In a presently preferred embodiment, the biasing member 60 includes a steel pneumatic cylinder 62 which houses nitrogen and hydraulic fluid. The cylinder 62 also retains a piston (not shown) attached to an end of a steel piston rod 63 which extends from an opening at a first end of the cylinder 62. Although the gas spring 60 may be connected between the crank plate 40 and the swing arm 50, it is presently preferred that the gas spring 60 be connected between the base plate 30 and the crank plate 40 about first and second composite socket eyes 64 and 66. The first eye 64 is coupled to an end of the piston rod 63 opposite the piston and is fastened to the base plate 30 about a ball stud 110 which engages the adjustment slot 39, as shown in FIG. 5. The stud 110 is adjustably fastened along the slot 39 by a nut plate 112 (shown in dashed lines) behind the adjustment slot 39.

As illustrated in FIG. 1, the second eye 66 is coupled to an end of the cylinder 62 opposite the first end and is connected to the crank plate 40 about a ball stud (not shown) fastened within one of the adjustment holes 48. The gas spring is connected between the base 30 and crank 40 in a relation which causes the spring 60 to urge the crank plate clockwise about the first hinge axis 72. The compressive preload of the gas spring 60 is adjusted by adjusting the relative locations of the sockets 64 and 66.

Figure 6:
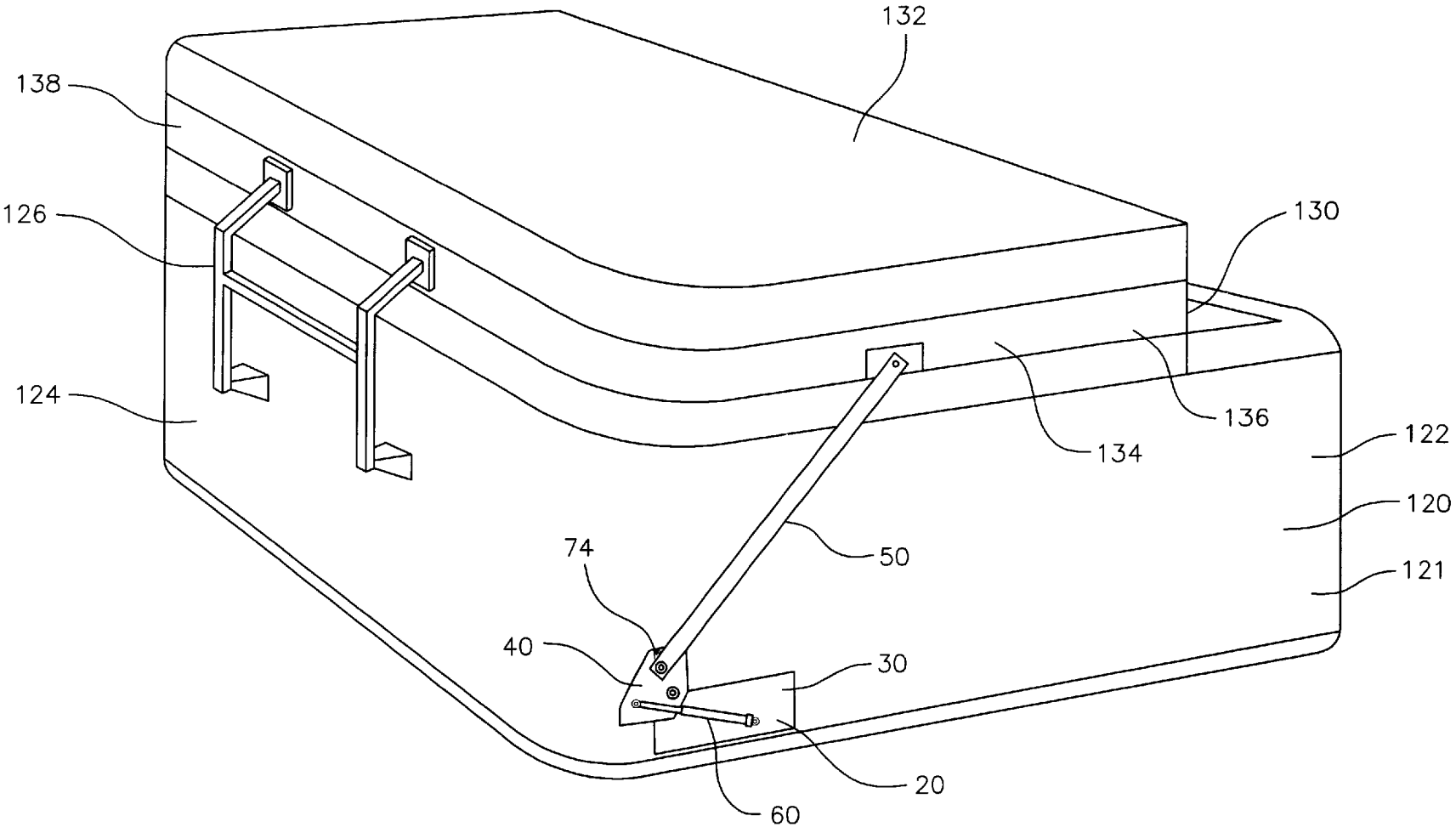
FIG. 6 is a perspective view showing the hinge of FIG. 1 connected between a spa housing and a spa cover atop the spa, in a closed state.
Figure 7:
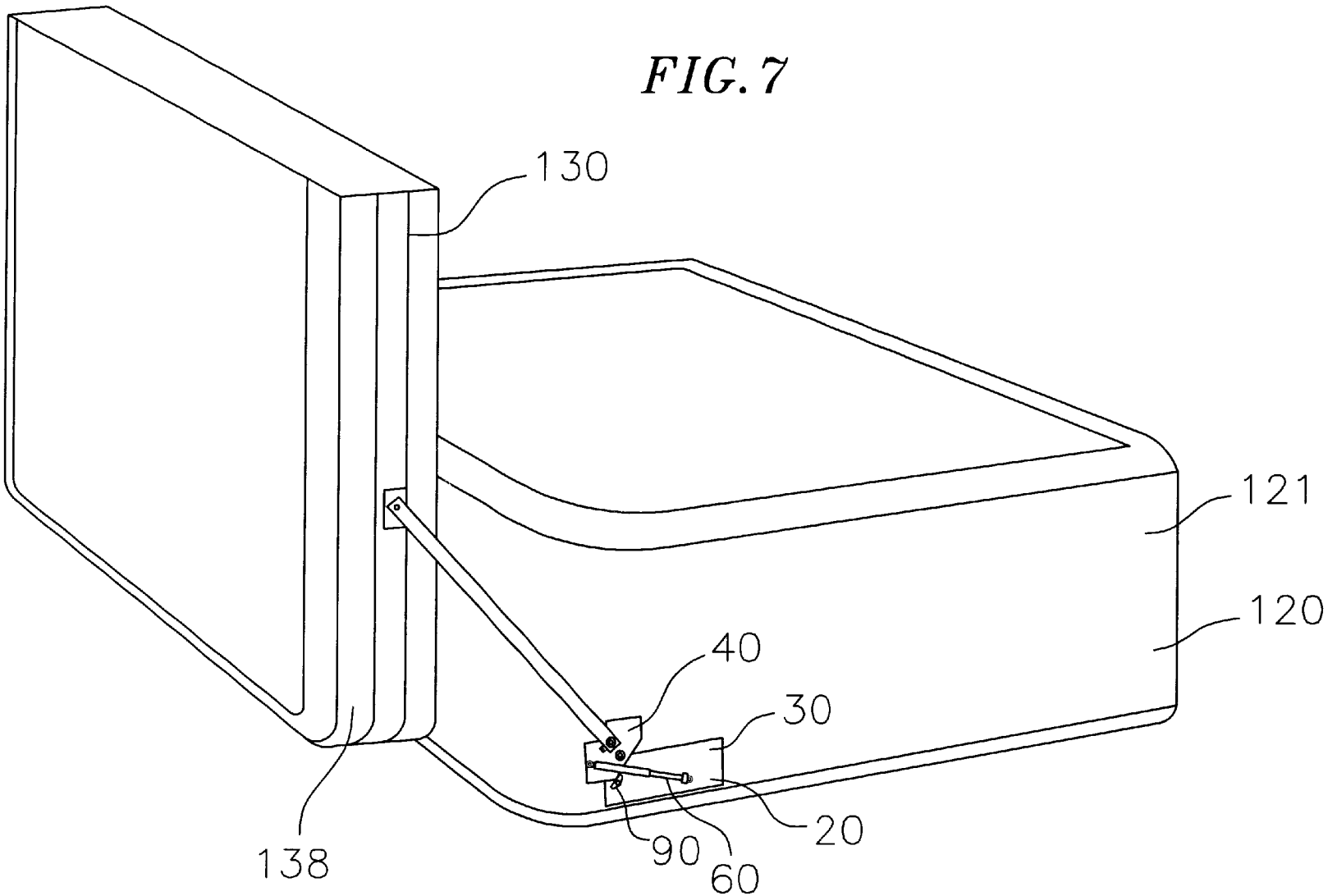
FIG. 7 is a perspective view of the hinge in FIG. 6, the spa cover being shown in a fully retracted state.
Figure 8:
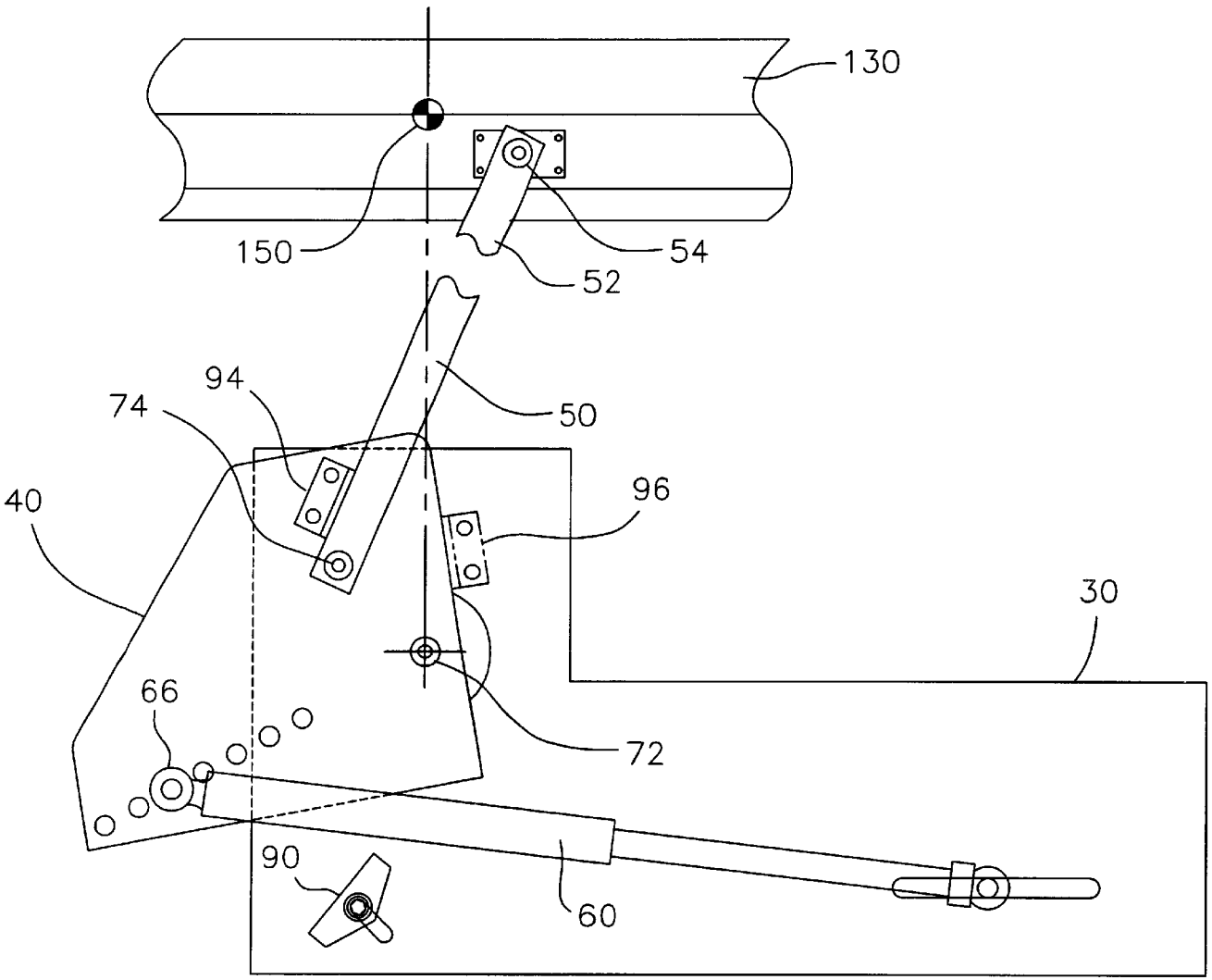
FIG. 8 is a fragmentary side view of the hinge in FIG. 6, the spa cover shown in an intermediate state.

Although the hinge of the present invention has many application, hinge 20 is specifically described in its use with a spa cover. Referring to FIGS. 6 to 8, a pair of hinges 20 are used to move a cover member 130, positioned on top of a spa 120 having housing 121 comprising a back wall 124 and sidewalls 122, from a closed or covering position of FIG. 6 along a rearward and rotational path to a fully open position of FIG. 7, where the cover member 130 is generally vertically aligned with a rearward portion of the spa 120.

Referring now to FIG. 6, the hinges 20 are fastened to the spa housing 121 at the base plate 30 along a lower side location of the sidewalls 122 near the rear of the spa 120. Each hinge 20 can be pinned to a side 136 of the spa cover 130 at the distal end of the swing arm 50 at a desired distance forwardly from a rear edge 138 of the cover 130. The pinned connection is a pivotal connection, and so the distal end of the swing arm 50 can rotate relative to the cover 130 about an axis which is fixed relative to the cover 130.

A guide link assembly 126 is coupled between a rear edge 138 of the spa cover 130 and the back wall 124 of the spa housing 120. The guide link assembly 126 guides the movement of the rear edge 138 of the cover 130 and helps to cause the hinges 20 to operate in synchronism with each other. A hinge cover (not shown) can be used to substantially enclose the hinges so they are protected from dirt and to provide safety to persons in the vicinity of the mechanisms as they are operate.

As installed, the first hinge axis is an axis which is fixed relative to the spa housing, while the second hinge axis is a moveable axis relative to the spa housing. The overall hinge mechanism relies on five pivot axes as follows: 1) an upper swing arm axis fixed to the cover, 2) a lower swing arm axis (the first hinge axis mentioned above) fixed to the crank plate but movable relative to the spa housing, 3) a lower side pivot axis (the second hinge axis mentioned above) of the crank plate which is fixed to the spa housing, 4) an upper rear link axis fixed to the rear of the cover, and 5) a lower rear link axis fixed to the rear of the spa housing.

Figure 9:
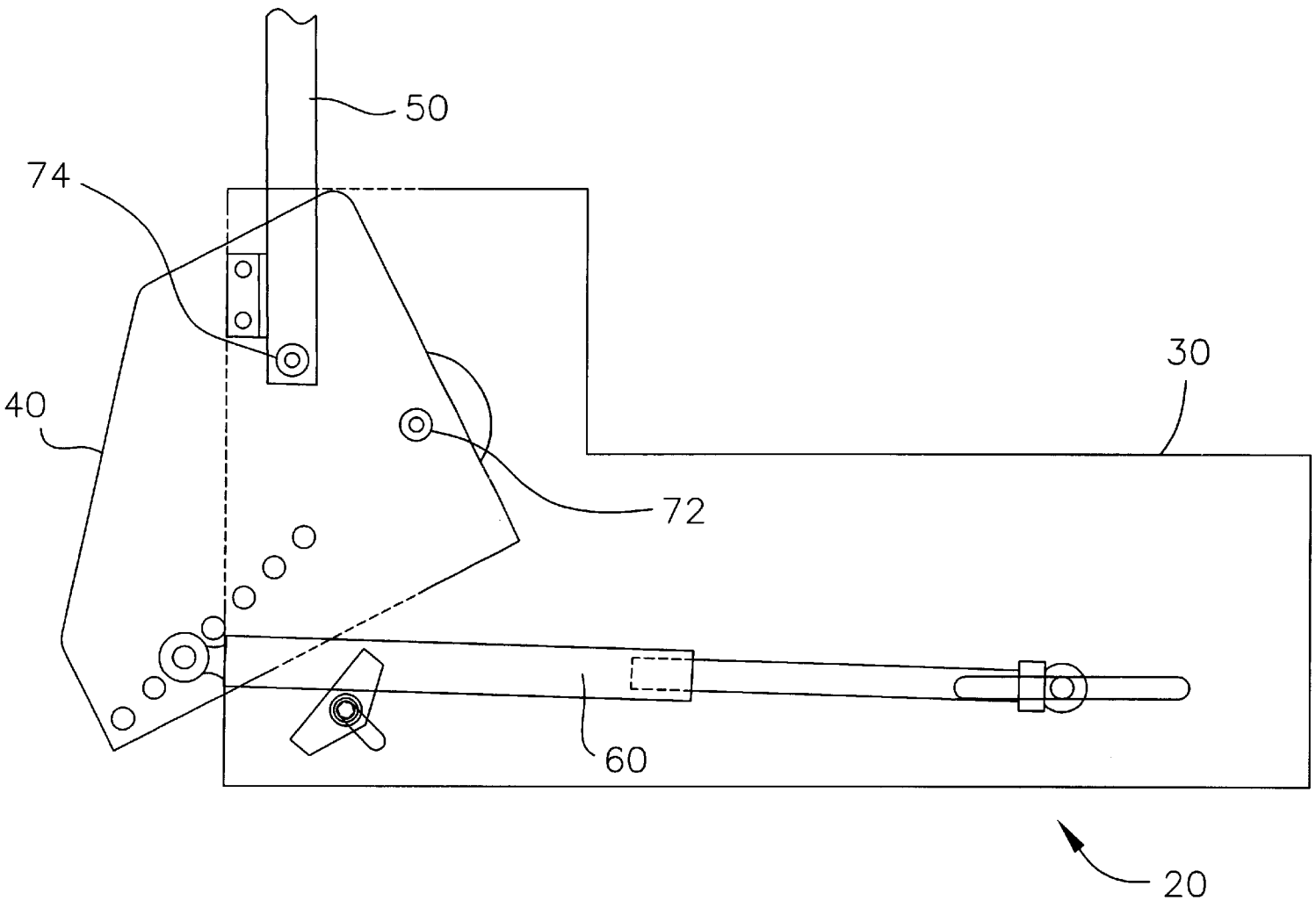
FIG. 9 is another side view of the hinge in FIG. 6.

Referring to FIGS. 6 and 8, the hinge operation, in the course of moving the spa cover 130 from its closed position atop the spa 120 to its open and stored position, begins with the crank plate 40 stationary relative to the base plate 30. Because the gas spring 60 is connected to the crank plate 40 stationary relative to the base plate 30. Because the gas spring 60 counterclockwise movement of the crank plate 40 about the first hinge axis 72 and so the swing arm 50 movement is accommodated as pivotal movement of the arm 50 only about the second hinge axis 74. As the cover 130 is pushed rearwardly, the distal end of the swing arm 50 follows and accommodates such motion of the cover 130 which, in addition to moving rearwardly, also rises from the top of the spa 120. The proximal end of the swing arm 50 initially moves only rotatably relative to the crank plate 40, as explained above. As noted, because the crank plate 40 is urged by the gas spring 60 to turn in a clockwise direction about the first hinge axis 72, so long as there is no impediment to movement of the swing arm 50 relative to the crank plate 40, only the swing arm 50 will move and the crank plate 40 will remain stationary. However, at some intermediate position, defined by the geometry of the hinge structure, the swing arm 50, adjacent its proximal end, will engage the retainer 94 carried by the crank plate 40, as shown in FIG. 8. Thereafter, motion of the cover 130 from atop the spa housing 121 toward its opened position can be accommodated only by rotation of the crank plate 40 about the fixed first hinge axis 72 and against the load of the gas spring 60 on the crank plate 40, as depicted in FIGS. 9. The swing arm 50 and the retainer 94 engage each other at about the middle of the range of movement afforded to the spa cover 130; the point at which the swing arm 50 engages retainer 94 can be varied by making the connection of the retainer 94 to the crank plate 40 an adjustable connection.

Figure 10:
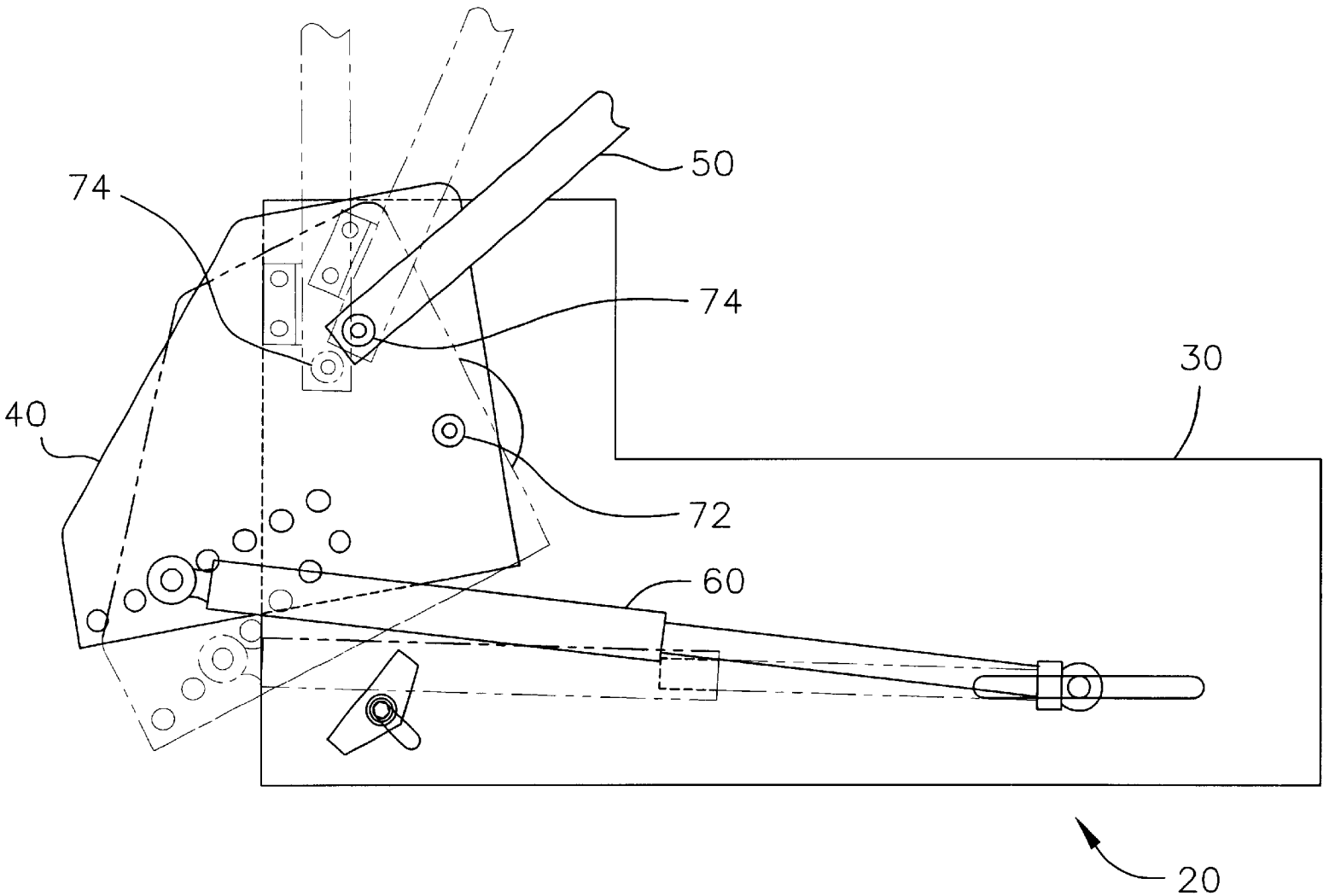
FIG. 10 is a side view of the hinge, wherein the swing arm is shown in various states

Referring to FIG. 10, it is seen that in about the first half of the movement of the spa cover, the swing arm 50 turns about the second hinge axis 74, representing a hinge axis relative to the crank plate 40 which is stationary relative to the base plate 30. In about the second half of the movement of the cover, the swing arm 50 and the crank plate 40 are effectively locked together, and it is the first hinge axis 72, which represents a hinge axis about which the swing arm 50 and the crank plate 40 rotate as a unit. That is, the location of pivotal movement of the swing arm 50 relative to the spa housing 121 shifts from the second hinge axis 74 to the first hinge axis 72. Also, it is in that second half of cover movement that motion of the cover is resisted by the gas spring 60.

Referring to FIG. 6, during movement of the cover 130 in either direction relative to the spa 120, the guide link assembly 126 merely guides the movement of the rear edge 138 of the cover 130 and resists rotation of the folded cover 130 about an axis perpendicular to it. The structure and operation of the hinge 20 is such that the swing arm 50 carries the weight of the cover 130, for the most part.

One of the several features of the hinge 20 is that the effect of the gas spring 60 is applied to the cover 130 only in the half (approximately) of the cover's movement which includes the stored position. That means that when the cover 130 is moved from its stored position toward its closed position atop the spa 120, in the last half of that motion, the gas spring 60 applies no force to the swing arm 50 and does not tend to slam the cover 130 into its closed position.

Referring now to FIG. 1, and as discussed above, the connections of the opposite ends of the gas spring 60 to the crank 40 and base 30 plates are adjustable in the hinge. The gas spring 60 can be coupled between the crank 40 and base 30 plates either in a relaxed (fully extended) state of the spring or in a partially compressed state. The second socket 66 of the gas spring 60 is pinned to the crank plate 40 via the adjustment holes 48 formed through the crank plate 40 at different distances from the first hinge axis 72. The farther the location of gas spring 60 connection to the crank plate 40 from the first hinge axis 72, the greater is the bias effect of the gas spring 60 on the crank plate 40 to resist counter-clockwise rotation of the crank plate 60 about the first hinge axis 72. The first socket 64 is pinned to the base plate 30 at an adjustable location along the adjustment slot 39 in the base plate 30. Referring now to FIG. 5, the ball stud 110 for the gas spring's 60 first socket 64 can be clamped to the base plate 30 at any location along that slot 39. As a result, the state of the gas spring 60 when the spa cover 130 is in its closed position can be adjusted to provide any level of spring preload on the crank plate 40 which may be desired.

Referring to FIG. 7, as noted above, the stop 90 on the base plate 30 is engageable by the crank plate 40 to limit the motion of the crank plate 40 counter-clockwise relative to the base plate 30. The stop 90 defines the retracted position of the cover 130. The stop 90 is mounted to the base plate 30 by a fastener engaging a nut on the underside of the second aperture 38. Alternatively, the stop 90 may be adjustably mounted to the base plate 30, as by a fastener passing through the stop element 90 and a semi-circular slot in the base plate 30 to a nut on the underside of the base plate 30. Accordingly, the retracted position of the cover 130 can be defined as shown in FIG. 7, or it can be defined in a more open relation to the spa 120 in which the rear edge 138 of the spa cover 130 is in close proximity to the spa housing 121. The stop 90 is mounted so that its presence on the base plate 30 does not interfere with movement of the gas spring 60. The load of the retracted cover 130 is carried to the spa housing 121 from the crank plate 40 via the base plate 30 and the retraction stop 90.

Referring to FIG. 8, the placement of a second stop 96 on the base plate 30 can be useful to define the position of the crank plate 40 at which movement of the swing arm 50 relative to the spa housing 121 shifts from the first hinge axis 72 to the second hinge axis 74 during movement of the cover 130 from its retracted position to its usage or closed position atop the spa. The time at which that shift occurs is the time when the gas spring 60 ceases to act on the swing arm 50. That time can be defined to be the time at which the swing arm 50 is vertical or that time when the center of mass 150 of the cover 130 is vertically above the first hinge axis 72. The use of such a stop 96 on the crank base plate 30 can be particularly helpful if it is desired to have the gas spring 60 under some level of compressive preload when the crank plate 40 begins to move against the action of the spring 60 as the spa cover 130 is moved to its retracted position. The second stop 96 can be viewed as a transition stop because it pertains to the transition of swing arm 50 motion from about the first hinge axis 72 to the second hinge axis 74 as the spa cover 130 is moved from is retracted position to its closed position.

The figures depict one of the two hinge mechanisms connected between the spa cover and the spa housing. The other hinge is a mirror image of the one depicted in the figures.

Referring now to FIG. 1, the position of the retainer 94 on the crank plate 40, the position of the stop 90 on the base plate 30, and the position of the second retaining member 96 (if present) on the base plate 30 can be adjustable. The swing arm 50 can be adjustable in length. Adjustability of the components of the hinge 20 enables a standard hinge mechanism to be used with a range of spas of different sizes.

In alternative embodiments, the hinge of the present invention can be used in such applications as cabinet or garage doors. Further, in other embodiments, the hinge of the present invention may be configured such that the first half of movement of the spa cover is resisted by a spring and the second half of movement is free from spring bias.

Figure 11:
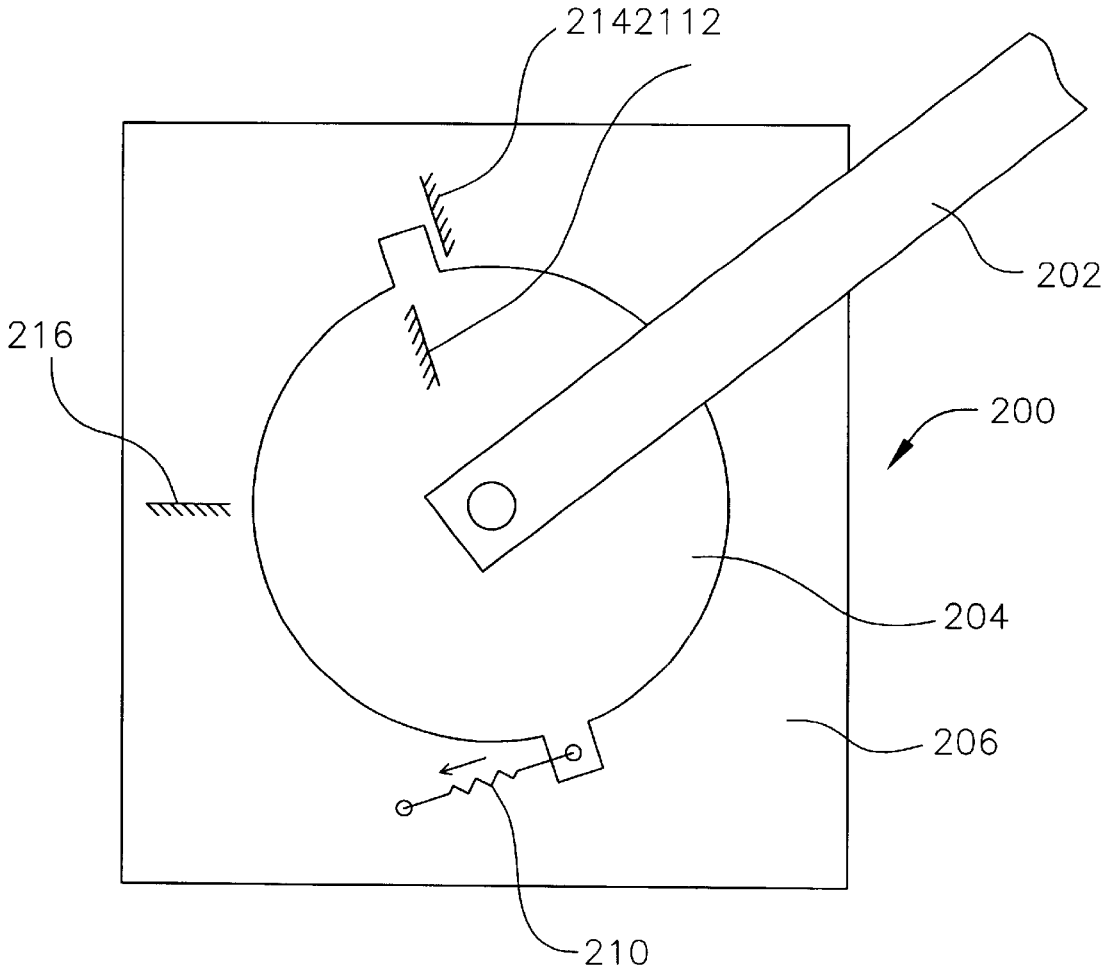
FIG. 11 is a simplified elevation view of an alternate embodiment of the spa cover hinge of the present invention.
Figure 12:
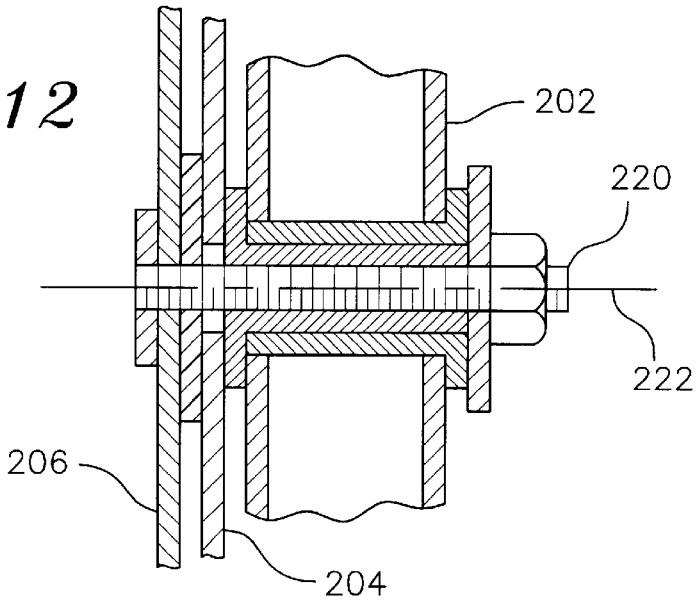
FIG. 12 is a fragmentary side view of the hinge in FIG. 11.

A hinge according to this invention may be arranged in a more compact fashion, having first and second hinge axes disposed coaxially of each other. Such an arrangement is present in hinge 200 shown in FIGS. 11 and 12. In this embodiment, a crank disc 204 is rotably coupled between a swing member 202 and a base member 206. The swing member 202 and crank disc 204 are assembled about an axle 220, defining a primary hinge axis 222. The crank disc 204 is urged toward a first position juxtaposed to a secondary stop 214 carried by the base member 206, by a tension spring 210 attached between the crank disc 204 and the base member 206.

Figure 14:
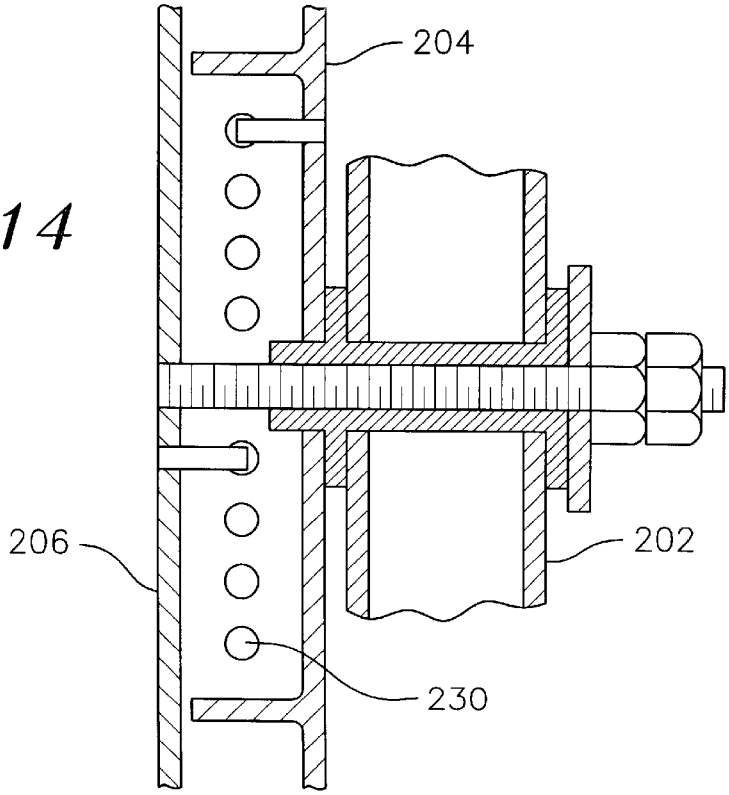
FIG. 14 is a fragmentary side view of a further embodiment of the spa cover hinge of the present invention.
Figure 13:
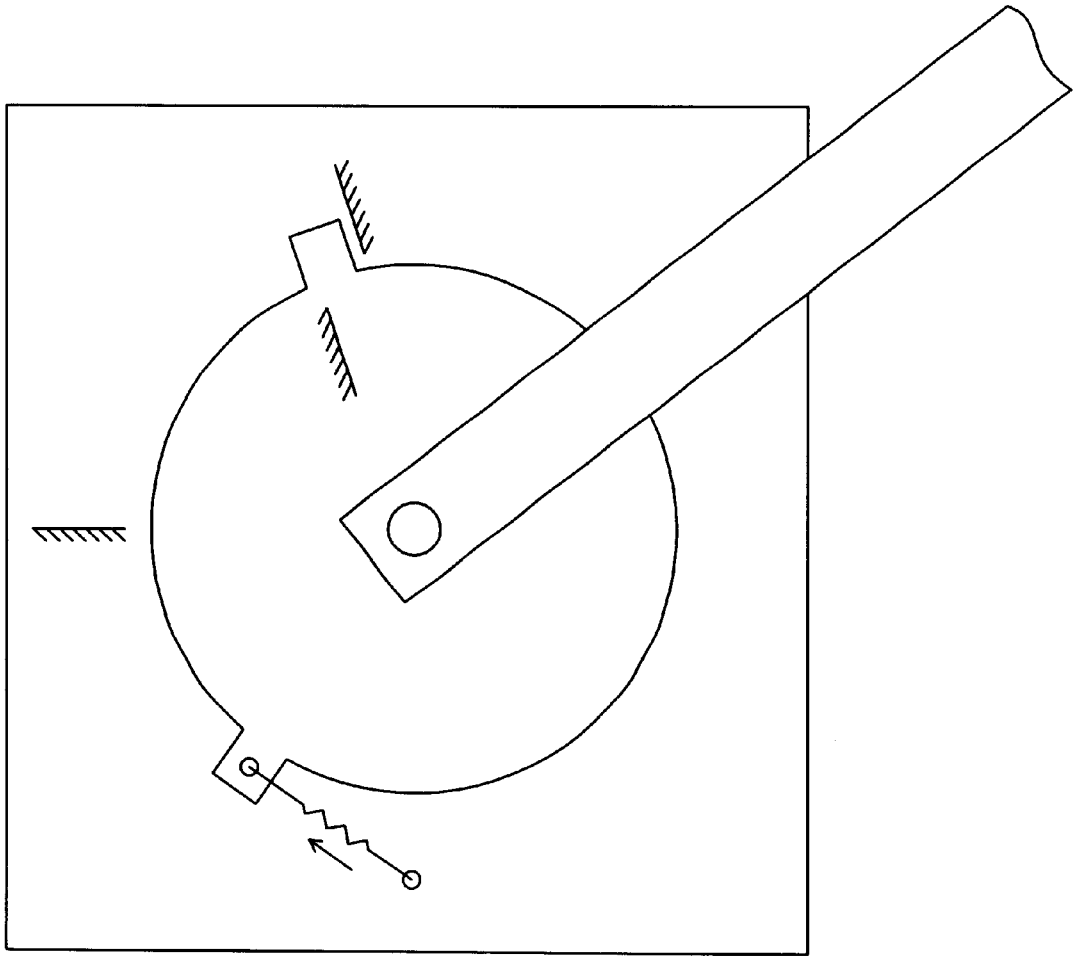
FIG. 13 is a simplified elevation view of a modified embodiment of the hinge in FIG. 11.

In a first range of movement, the swing member 202 may rotate freely in a counterclockwise direction until is engages a primary stop 212 carried by the crank disc 204. Upon engaging the primary stop 212, a force may be applied to the swing member 202 to overcome the spring bias, rotating the crank disc 204 in a second range of movement between the secondary stop 214 and a limiter 216. In the second range of movement, the spring 210 acts to return the crank disc 204 back to its first position. In a modified embodiment, a compression spring may be used as illustrated in FIG. 13. In a further modified embodiment, FIG. 14 depicts the use of a coil torsion spring 230 attached and disposed between the base member 206 and a cavity in the underside of the crank disc 204.

In view of the foregoing, it will be seen that this invention provides a hinge which is mountable between two relatively moveable articles. The hinge comprises a base member mountable to one of the articles, and a first movable member mountable to the other article. The hinge also comprises an intermediate member rotatable about a first axis fixed to the base and relative to which the first member is rotatable about a second axis fixed relative to the intermediate member. The hinge also includes a spring. The spring is coupled to the intermediate member and to one of the set of members comprised by the base and first members, to impose a selected bias effect upon relative rotation of the members between which the spring is coupled. A rotation stop is engageable between the intermediate member and the other of the members of the set comprised by the base and first members. A first portion of motion between the base and first members occurs without effect on the spring, and a remainder portion of motion between the base and first member occurs with effect of the spring. It will be seen that the first and second axes can be spaced from each other, or they can be coaxial.

It is to be understood that the various embodiments described above are provided by way of illustration only and should not be construed to limit the invention. Those skilled in the art will recognize various modifications and changes that may be made to the present invention without strictly following the example embodiments and applications illustrated and described herein and without departing from the true spirit of the present invention, which is set forth in the following claims.

What is claimed is:

1. A hinge mountable between two relatively movable articles and comprising a base member mountable to one of the articles, a first movable member mountable to the other article, and an intermediate member rotatable about a first axis fixed to the base and relative to which the first member is rotatable about a second axis fixed relative to the intermediate member, a spring coupled between the intermediate member and to one of the base and the first members to impose a selected bias effect upon relative rotation of the members between which it is coupled, and a rotation stop engagable between the intermediate member and the other of the base and first members, and in which a first portion of motion between the base and first members occurs without effect of the spring and a remainder portion of motion between the base and first members occurs with effect of the spring.

2. The hinge of claim 1 wherein the bias effect is resistive to relative rotation.

3. The hinge of claim 1 wherein the first and second axes are collinear.

4. The hinge of claim 1 wherein the first and second axes are parallel and spaced apart.

5. A hinge comprising a base, a plate carried on the base and rotatable relative to the base about a turn axis fixed in the base, a swing arm rotatable relative to the plate about a pivot axis fixed relative to the plate, a spring coupled between the base and the plate urging the plate to rotate about the turn axis in a first direction, the plate having an optional turn limit of rotation in the first direction about the turn axis, the swing arm having a pivot limit of movement relative to the plate about the pivot axis in a pivot direction which is substantially the opposite of the first direction, and in which movement of the swing arm toward and away from the pivot limit occurs about the pivot axis without effect of the spring on the arm, and in which the arm and the plate can move about the turn axis with effect of the spring thereon during contact of the swing arm with the pivot limit.

6. The hinge of claim 5 wherein the turn and pivot axes are spaced from and parallel to each other.

7. The hinge of claim 5 wherein the spring is operatively connected between the base and the plate.

8. The hinge of claim 5 wherein the plate has a second turn limit of rotation in a direction opposite the first direction, about the turn axis.

9. The hinge of claim 5 wherein the turn and pivot axes are collinear.

10. A hinge mechanism connectible between a spa foundation and a spa cover having a closed position atop the foundation and an open position, the mechanism comprising:

a base plate attachable to a side of a spa foundation;

a crank plate rotably coupled to the base plate about a first axis fixed in the base platel;

a swing arm having proximal and distal ends, the arm being rotably coupled at its proximal end to the crank plate about a second axis fixed in the crank plate and spaced apart from the first axis, the distal end being connectible to a spa cover;

a stop mounted onto the crank plate for limiting rotation of the swing arm about the second axis;

a spring operatively connected between the base plate and the crank plate at a location on the crank plate apart from the second axis, and exerting a force on the crank plate creating a first moment in a first rotational direction about the first axis;

whereby a spa cover connected to the arm at its distal end can travel along a path from its closed position to an open position along a first path segment from the first closed position to an intermediate position in which the crank plate does not rotate relative to the base plate, and a second path segment of motion from the intermediate position and an open position of the cover relative to the foundation in which the crank plate turns about the second axis and acts against the force of the spring.

11. A hinge for opening and closing a panel relative to a frame, the hinge comprising:

a base member connectible to the frame;

a first member rotably coupled to the base member about a first pivot;

a second member connectible to the panel and rotably coupled to the first member about a second pivot; and a spring coupled between the base member and the first member at a location of the first member apart from the second pivot, the spring exerting a force against the first member creating a moment about the first axis in a first rotational direction, the second member having a limit of rotation in the opposite direction relative to the first member.

12. A hinge comprising:

a base plate;

a crank plate coupled to the base plate and rotatable relative to the base plate about a first axis;

a swing arm coupled to the crank plate and rotatable relative to the crank plate about a second axis;

A biasing member coupled between the base plate and the crank plate, the biasing member biasing the crank plate toward a first angular position relative to the base plate and exerting a force on the crank plate urging the crank plate toward the first angular position of the crank plate relative to the base plate, the force being adequate to hold the crank plate from moving about the first axis during movement of the swing arm about the second axis relative to the crank plate.

13. The hinge of claim 12 including a retainer on the crank plate limiting rotation of the swing arm relative to the crank plate.

14. The hinge of claim 13 wherein the swing arm is rotatable, free of effect of the biasing member, toward and away from engagement of the swing arm with the retainer.

15. The hinge of claim 14 in which hinge motion about the first axis with effect of the biasing member can occur in response to an application of force to the swing arm, inducing rotation of the arm and crank plate about the first axis while the swing arm is engaged with the retainer.

16. The hinge of claim 15 including a stop on the base plate engageable by the crank plate defining a limiting position of the crank plate relative to the base plate.

17. The hinge of claim 16 wherein the force exerted on the crank plate by the biasing member increases as the crank plate rotates under load applied to the crank plate by the swing arm in engagement with the retainer.

18. The hinge of claim 12 wherein the first axis is parallel to and spaced apart from the second axis.

19. The hinge of claim 12 wherein the first and second axes are collinear.

* * * * *

UNITED STATES PATENT AND TRADEMARK OFFICE

CERTIFICATE OF CORRECTION

PATENT NO. : 6,442,799 B1
DATED : September 3, 2002
INVENTOR(S) : Carlos Duarte et al.

It is certified that error appears in the above-identified patent and that said Letters Patent is hereby corrected as shown below:

Column 8,
Line 54, replace "platel" with -- plate --.

Signed and Sealed this

Fourth Day of March, 2003

JAMES E. ROGAN
*Director of the United States Patent and Trademark Office*